US006571593B1

(12) United States Patent
Chung et al.

(10) Patent No.: US 6,571,593 B1
(45) **Date of Patent: *Jun. 3, 2003**

(54) CONTINUOUS SHEAR DEFORMATION DEVICE

(75) Inventors: Young-Hoon Chung, Seoul (KR); Jong-Woo Park, Seoul (KR); In-Ge Moon, Seoul (KR); Myung-Chul Shin, Seoul (KR)

(73) Assignee: Korea Institute of Science & Technology, Seoul (KR)

( * ) Notice: Subject to any disclaimer, the term of this patent is extended or adjusted under 35 U.S.C. 154(b) by 166 days.

This patent is subject to a terminal disclaimer.

(21) Appl. No.: 09/653,142

(22) Filed: Aug. 31, 2000

(30) Foreign Application Priority Data

Jan. 28, 2000 (KR) ..... 00-4291

(51) Int. Cl.[7] ..... B21C 23/00
(52) U.S. Cl. ..... 72/262; 72/253.1
(58) Field of Search ..... 72/253.1, 257, 72/262, 256, 270, 289

(56) References Cited

U.S. PATENT DOCUMENTS

| | | | | | |
|---|---|---|---|---|---|
| 3,871,201 A | * | 3/1975 | Hayashi et al. | ..... | 72/262 |
| 4,546,634 A | * | 10/1985 | Fuchs, Jr. | ..... | 72/262 |
| 6,370,930 B1 | * | 4/2002 | Lee et al. | ..... | 72/262 |

FOREIGN PATENT DOCUMENTS

| | | | | | |
|---|---|---|---|---|---|
| GB | 1467089 | * | 3/1977 | ..... | 72/262 |
| JP | 55-33824 | * | 3/1980 | ..... | 72/262 |
| JP | 59-113920 | * | 6/1984 | ..... | 72/262 |
| JP | 1-104410 | * | 4/1989 | ..... | 72/262 |
| JP | 2-235515 | * | 9/1990 | ..... | 72/262 |
| JP | 3-275213 | * | 12/1991 | ..... | 72/262 |

OTHER PUBLICATIONS

Equal Channel Angular Pressing: A Novel Tool for Microstructural control, by Minoru Nemoto, et al., Metals and Materials, vol. 4, No. 6, 1998, pp. 1181–1190.

* cited by examiner

*Primary Examiner*—Ed Tolan
(74) *Attorney, Agent, or Firm*—Scully, Scott, Murphy & Presser

(57) ABSTRACT

The present invention relates to a continuous shear deformation device, in particular, which is capable of mass-producing shear deformed materials by continuously supplying a sharply bent channel type mold with materials, particularly, which have a variety of thickness from thin sheet to thick plate. The continuous shear deformation device in accordance with the present invention includes a sharply bent channel type mold and a rotary guide apparatus installed at the inlet of the mold for guiding materials into the mold by frictional contact with the materials. In addition, the present invention can additionally include a rotary guide for exiting the shear-deformed material.

17 Claims, 5 Drawing Sheets

CONTINUOUS SHEAR DEFORMATION DEVICE

BACKGROUND OF THE INVENTION

1. Field of the Invention

The present invention is related to a continuous shear deformation device, in particular, which is capable of mass-producing shear deformed metallic materials by continuously supplying the metallic materials to a sharply bent channel type mold.

2. Description of the Background Art

When a metal billet is pushed into a sharply bent channel type mold by punch, shear deformation occurs while the metal is passing through the sharply bent zone of the mold, which is generally known as ECAP (Equal Channel Angular Pressing). The inlet and the outlet of an ECAP mold have the same shape and cross-sectional area. Fine grain structure is obtained by ECAP and thus stiffness and plasticity of materials are improved (Metals and Materials, Vol. 4, No. 6, 1998, pp. 1181~1190).

However, in a shear deformation device using a punch in the conventional art, there is a limitation on the size of a supplied billet, so that only a shear-deformed material of a limited length can be obtained. Moreover, once the billet is extruded, the next billet can be extruded only after extracting the punch from the mold. Thus, shear-deformed material has to be intermittently produced by small amounts.

In addition, when the punch is overloaded in the shear deformation device in the conventional art, there is another problem that the overload is directly transferred to the punch and thus the punch and the punch driving apparatus can be damaged or break down.

SUMMARY OF THE INVENTION

Accordingly, it is an object of the present invention to provide a device which is capable of continuously mass-producing shear deformed materials, with no limitation on the length of material, by continuously supplying the metallic materials to an ECAP mold.

In addition, it is another object of the present invention to provide a continuous shear deformation device which is capable of continuing to operate smoothly though an apparatus for supplying materials into a mold is unintentionally overloaded.

Meanwhile, it is still another object of the present invention to provide a continuous shear deformation device which is capable of reducing friction between a mold and materials, accordingly increasing the life span of the mold, decreasing the force required for press-fitting materials, and thereby reducing the whole operating costs In addition, it is yet still another object of the present invention to provide a continuous shear deformation device which can be compatibly used according to materials, in particular, materials of different thickness from thin sheet to thick plate material.

In order to achieve the above objects, there is provided a continuous shear deformation device in accordance with the present invention, including: a sharply bent shear deformation mold; and a rotary guide apparatus installed at the inlet of the mold for guiding materials into the mold by frictional contact with the material.

In accordance with a preferred embodiment of the present invention, rotary type rolls such as a single rotary roll, a pair of rotary rolls and plurality of rotary rolls, etc. are used as the above inlet guide apparatus. Instead of rotary type rolls, belts of various shapes, including a loop in which a plurality of polyhedral blocks are sequentially connected or a belt having an inner side of chain form, etc. can be used. In addition, guide apparatuses of the preferred embodiment can be used in combination with each other. For example, rotary type rolls are used at one side and a belt transmission are used at the other side. Even in case of employing a belt transmission, belts of various forms can be used in combination. In addition, a plurality of guide apparatuses can be used according to design objective such as required friction force. The description in this paragraph will be directly applied to an outlet guide to be mentioned later.

In addition, in the present invention, an outlet rotary guide for exiting materials after shear deformation can be provided additionally.

In accordance with another preferred embodiment of the present invention, a transmission belt can be used as a guide for exiting materials, immediately after shear deformation, to the outside of the mold inlet by frictional contact between the belt and the shear-deformed materials. In addition, in accordance with another embodiment, the guide can be a rotary roll or a transmission belt installed at the outside of the outlet which feeds discharged materials and winds or flattens materials.

In addition, in accordance with another preferred embodiment of the present invention, the mold can be provided with an inclined or a curved inlet in order to increase the amount of contact between the guide apparatus and materials.

In addition, the thickness of materials prior to passing through the guide apparatus of the present invention may be greater than that of materials after passing through the guide apparatus. In this case, the material is rolled according to the clearance space of its supply path, and thereby it is possible to provide a shear deformation device which can be compatibly used according to materials, for example, materials of different thickness from thin sheet materials less than 0.5 mm to thick plate materials, with no limitation on thickness. In a case where there is a wide difference between the thickness of materials and the thickness of a molding path, the material can be provided to a mold by gradually reducing the thickness of the material using several pairs of rolls and/or other guide apparatuses.

In addition, in accordance with another embodiment of the present invention, a frictional contact can be provided with a groove corresponding to the cross-sectional shape of materials in order to increase the frictional contact force between the guide apparatus or guide feeder and the materials. And, it can be covered with any particular material of high friction coefficient, its surface roughness can be increased, or materials of high friction coefficient can be directly used as a body of a guide apparatus.

Additional advantages, objects and features of the invention will become more apparent from the description which follows.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will now be described with reference to the accompanying drawings.

Figure 1:
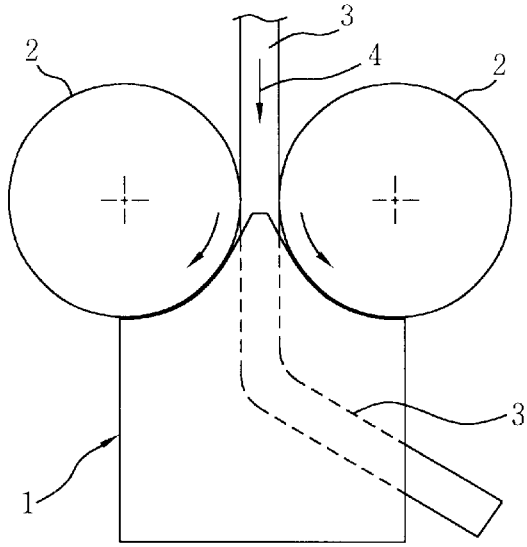
FIG. 1 is a schematic view illustrating a continuous shear deformation device using a pair of rotary rolls as a guide apparatus in accordance with one embodiment of the present invention.

FIG. 1 is a schematic view illustrating a continuous shear deformation device using a pair of rotary rolls as a guide apparatus 2 in accordance with one embodiment of the present invention. As illustrated therein, material 3 is continuously supplied into a mold 1 by installing the pair of rotary rolls at the inlet of the shear deformation device and then using the frictional contact force between the material 3 and the device. The supplied material 3 passing through the mold 1 is shear-deformed, and thereafter discharged to the outlet.

If the material 3 is thick and outside angle of the mold 1 is large, the force required for shear deformation is increased and accordingly a strong press fit force is required. In this case, several pairs of rotary rolls can be installed at the inlet of the shear deformation device. In addition, materials can be supplied easily by covering the rotary rolls with material of high friction coefficient or roughing their surfaces while reducing the mold contact path 8, smoothly processing a molding path 8 and supplying the same with lubricant. If the material 3 is thin and its bending angle is small, the force required for shear deformation is reduced and accordingly the material 3 is well supplied into the mold 1 without slipping on the rotary rolls. However, if the distance between the rotary rolls and the inlet of the mold is wide when the material 3 is thin, there is a possibility that the material 3 could be buckled without being smoothly supplied into the mold 1. Thus, the guide apparatus 2 needs to be installed at a position close to the mold 1, if possible. In accordance with one embodiment of the present invention, the material 3 passing through the mold 1 to be discharged to the out let can be cut at an appropriate size by installing a cutter (not shown) at the outlet of the mold 1.

In the shear deformation device of the present invention, in the case that the guide apparatus 2 is overloaded, a slip is occurred between the guide apparatus 2 and the material 3 and thus it serves as a safety equipment, thereby preventing damage to the guide apparatus 2 due to unintentional overload.

Figure 2:
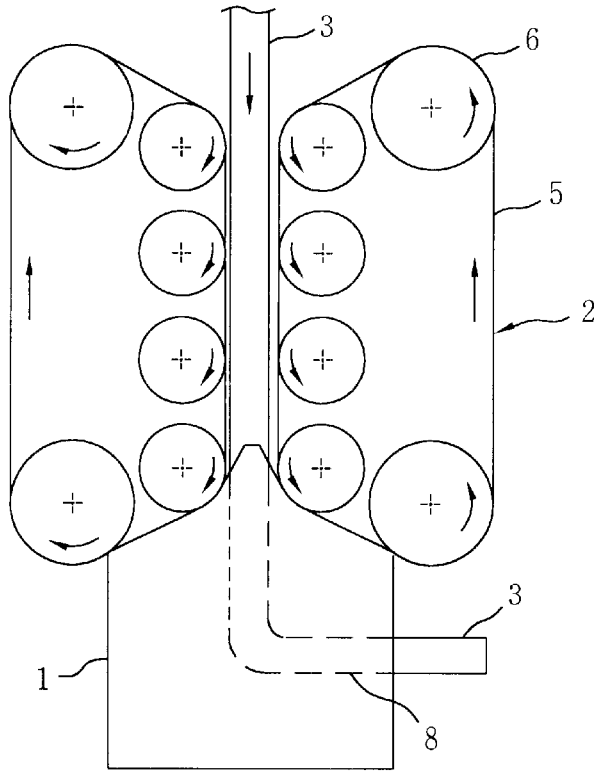
FIG. 2 is a schematic view illustrating a continuous shear deformation device using a belt transmission as a guide apparatus in accordance with another embodiment of the present invention.

FIG. 2 is a schematic view illustrating a continuous shear deformation device using a belt transmission as a guide apparatus 2 in accordance with another embodiment of the present invention. As illustrated therein, in the guide apparatus 2 of this embodiment continuously feeds material 3 by frictional contact between the belt 5 and the material 3 by installing a rotary belt 5 with a plurality of rotary rolls 6 surrounded by rubber or a metal. In this apparatus, a very high press fit force is generated because the area of contact between the rotary belt 5 and the material 3 is wide. Thus, the guide apparatus 2 is particularly useful when the material 3 is thick and its bending angle is large.

In accordance with another embodiment of the present invention, when there is a necessity for surely acquiring a transmission between the belt 5 and the rotary rolls 6 for driving the belt, a belt 5 having an inner side of chain shape and rotary rolls 6 of sprocket shape are used for thereby making them engaged with each other.

Figure 3:
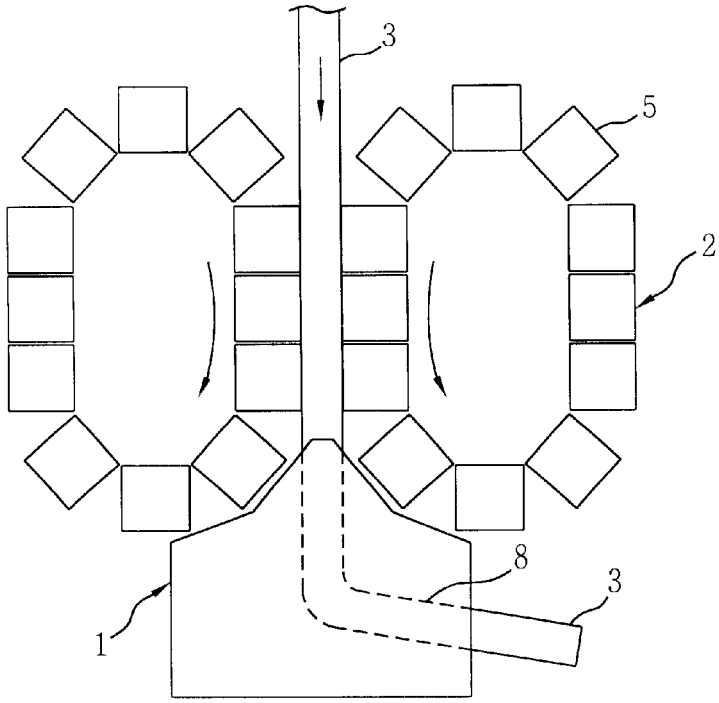
FIG. 3 illustrates a guide apparatus using a loop type belt in which a plurality of polyhedral blocks are sequentially connected in accordance with another embodiment in conjunction with the belt type guide apparatus of FIG. 2.

FIG. 3 illustrates a guide apparatus using a loop type belt in which a plurality of polyhedral blocks are sequentially connected in accordance with another embodiment in conjunction with the belt type guide apparatus 2 of FIG. 2. Since the apparatus of FIG. 3 also has a wide area of contact between the guide apparatus 2 and the material 3, it can push the material 3 continuously with a very high press fit force.

Figure 4:
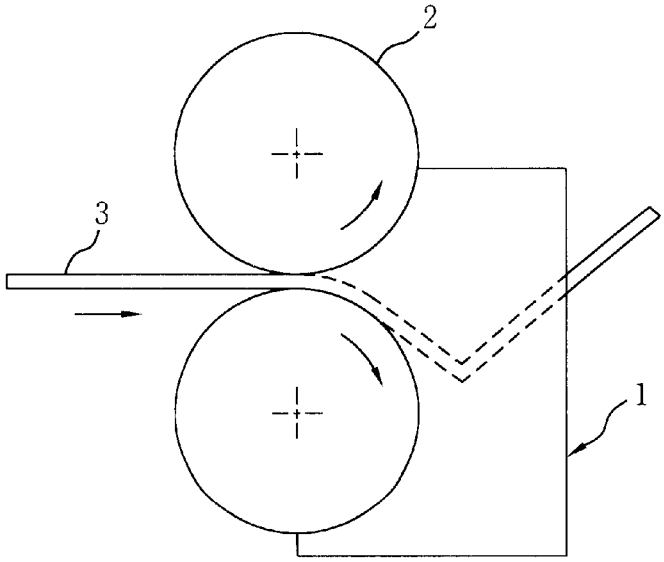
FIG. 4 is a schematic view illustrating a shear deformation device using a mold having an inclined inlet in accordance with another embodiment of the present invention.

FIG. 4 is a schematic view illustrating a shear deformation device using a mold having a curved and inclined inlet in accordance with another embodiment of the present invention. As illustrated therein, since the material 3 travels between the two guide apparatuses 2, that is, the two rotary rolls, and then is supplied into the inlet of the mold while continuously being contact with one of the rotary rolls for a fairly long distance, the area of friction between the rotary roll and the material 3 is increased thereby to obtain a high press fit force.

Figure 5:
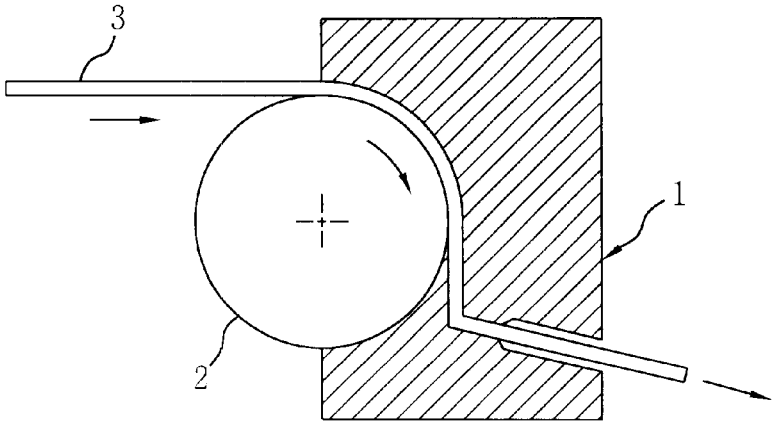
FIG. 5 is a view illustrating a shear deformation device using a guide apparatus of a single roll in accordance with another embodiment of the present invention.

FIG. 5 is a view illustrating a shear deformation device using a guide apparatus 2 in accordance with another embodiment of the present invention. In a case that the material 3 is sufficiently guided by a relatively small press fit force, as illustrated in FIG. 5, the material can be guided by using only one guide apparatus 2. In this embodiment, as illustrated therein, it is preferable that the mold 1 has an inclined path with short contact area of outlet.

Figure 6:
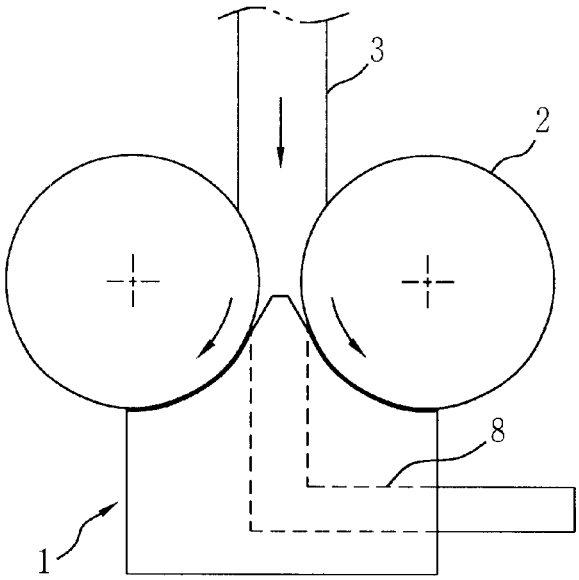
FIG. 6 is a schematic view illustrating a shear deformation device in which the thickness of the materials is reduced by the guide apparatus in accordance with another embodiment of the present invention.

FIG. 6 is a schematic view illustrating a shear deformation device in which the thickness of materials is reduced by the guide apparatus 2 in accordance with another embodiment of the present invention. As illustrated therein, the thick material 3 is made thin by the rotary rolls, and then supplied into the mold 1. Since this apparatus has a wide area of contact between the roll and the material 3 and pushes the material while firmly pressing the same, a high press fit can be generated without covering the rotary roll with a rubber film or roughing the surfaces of the rolls. In addition, there is an advantage that since a variety of materials 3 can be used in this apparatus, any particular process for obtaining a material of a thickness corresponding to the mold 2 is not required. In the case that the thickness of an initial material 3 is very thick, the material can be supplied into the mold 1 by gradually reducing the thickness while passing through a several pairs of rotary rolls.

Figure 7A:
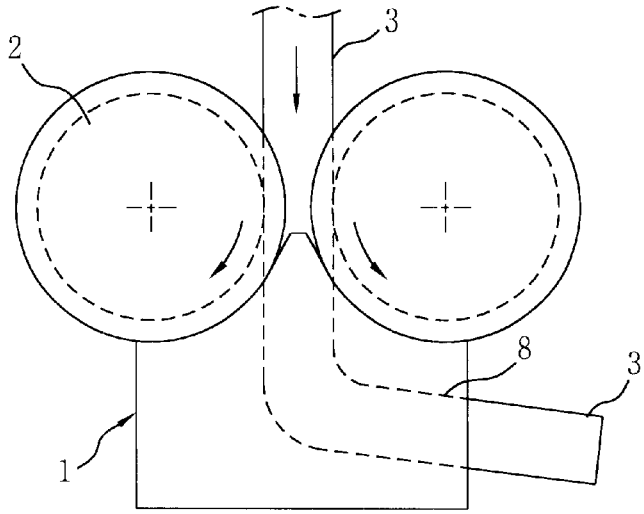
FIG. 7A is a schematic view of a shear deformation device.
Figure 7B:
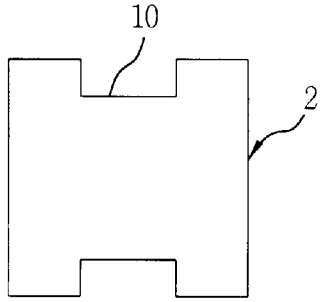
FIGS. 7B and 7C are cross-sectional views of a rotary roll, each in accordance with one embodiment of a guide apparatus for increasing the area of contact with materials.
Figure 7C:
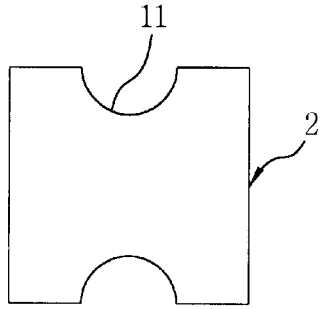

FIG. 7A is a schematic view of a shear deformation device, and FIGS. 7B and 7C are cross-sectional views of a rotary roll, each in accordance with one embodiment of a guide apparatus for increasing the area of contact with material. As illustrated therein, a square groove (FIG. 7B) 10 or a round groove (FIG. 7C) 11 corresponding to the cross-sectional shape of the material 3 is engraved on the surfaces of the rotary rolls, and accordingly the area of contact between the rotary rolls and the material 3 is very large so that a high press fit force is generated. If the material 3 is compressed and pushed as in the embodiment of FIG. 6 when passing through the rotary rolls, a much higher press fit force can be obtained.

Figure 8A:
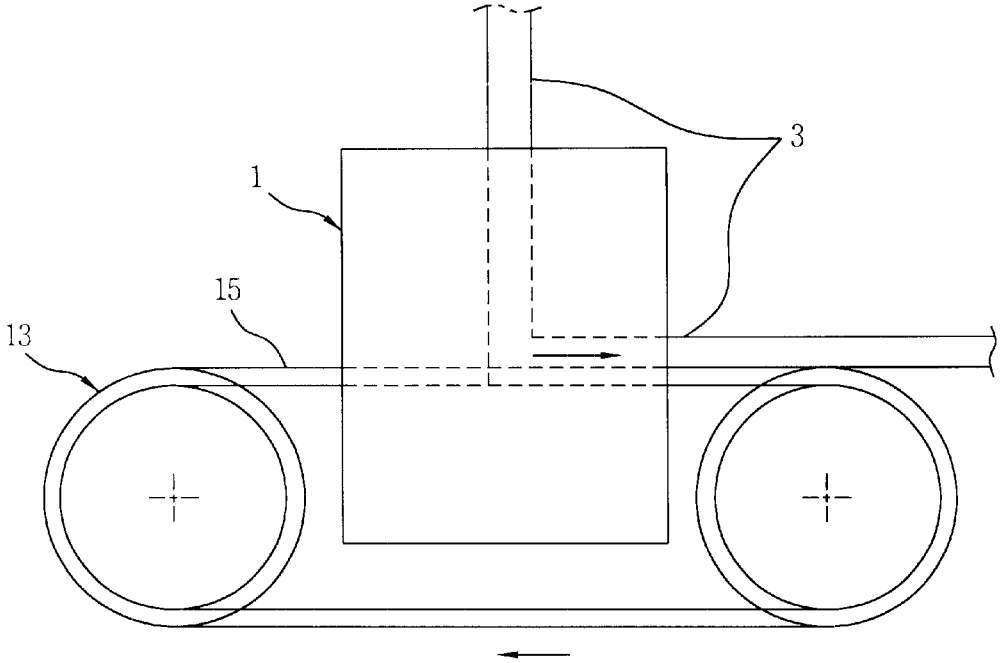
FIGS. 8A and 8B each are a lateral view and a front view illustrating a guide for feeding material after shear deformation in accordance with one embodiment of the present invention.
Figure 8B:
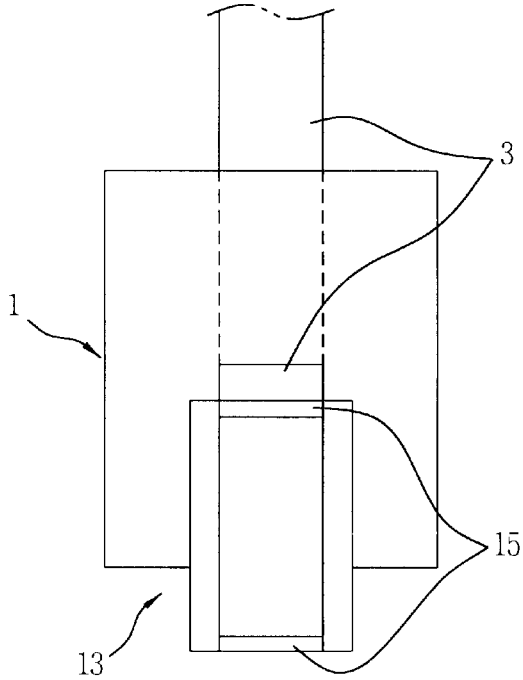

FIGS. 8A and 8B each are a lateral view and a front view illustrating a guide 13 for exiting material after shear deformation in accordance with one embodiment of the present invention. As illustrated therein, a belt type guide 13 for exiting material is installed from the curve point of the molding path 8 to the outside of the outlet, thereby reducing the frictional resistance. Belts of various structures and shapes including a belt 15 made by connecting metal plates or pieces of material of high stiffness and a loop type belt in which polyhedral blocks are sequentially connected can be used for the above belt type guide 13.

Because the guide 13 continuously moves with the material 3, it serves to reduce the area of friction between the material 3 and the mold 1 for thereby increasing the life of the mold and decrease the force required for press-fitting the material.

Meanwhile, in accordance with another embodiment of the guide 13, feeding of the materials can be performed by installing the rotary rolls outside the outlet of the mold 1. This guide serves to not only reduce the force required for press-fitting the material, but also wind the discharged material or flatten the surfaces.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims. For example, the guide apparatus 2 and the guide 13 as well as the mold in accordance with the present invention can have a variety of shapes and structures, and the components constructing the present invention, each of which having been described in its embodiment, can be used in combination with each other.

In accordance with the present invention thus described, it is possible to continuously mass-produce shear deformed materials, with no limitation on material, by continuously supplying a curved shear deformation mold with material.

In addition, in the present invention, it is possible to continue to operate smoothly though a supply apparatus for supplying material into a mold is unintentionally overloaded, with no influence on the device according to the overload.

Meanwhile, in the present invention, it is possible to reduce friction between a mold and materials, accordingly increase the life of the mold, decrease the force required for press-fitting material, and thereby reduce the whole operating costs In addition, the present invention can be compatibly used according to materials, in particular, materials of different thickness from thin sheet materials to thick plate materials.

What is claimed is:

1. A continuous shear deformation device, comprising:

a mold formed with a curved molding path having an equal channel for obtaining shear deformation of material passing through the molding path; and a rotary guide apparatus installed at the inlet of the molding path for continuously supplying and guiding material into the molding path by frictional contact with the material.

2. The device of claim 1, wherein the mold comprises a curved and inclined inlet in order to increase the amount of contact between the guide apparatus and the material.

3. The device of claim 1, wherein the clearance space of a supply path formed by the guide apparatus is less than the thickness of materials introduced into the guide apparatus.

4. The device of claim 1, wherein a frictional contact with materials in the guide apparatus comprises a groove corresponding to the cross-sectional shape of the material.

5. The device of claim 1, wherein the guide apparatus is a rotary roll.

6. The device of claim 5, wherein the mold comprises a curved and inclined inlet in order to increase the amount of contact between the guide apparatus and the material.

7. The device of claim 5, wherein the clearance space of a supply path formed by the guide apparatus is less than the thickness of materials introduced into the guide apparatus.

8. The device of claim 5, wherein a frictional contact with material in the guide apparatus comprises a groove corresponding to the cross-sectional shape of the material.

9. The device of claim 1, wherein a belt transmission is used as the guide apparatus.

10. The device of claim 9, wherein the mold comprises a curved and inclined inlet in order to increase the amount of contact between the guide apparatus and the material.

11. The device of claim 9, wherein the clearance space of a supply path formed by the guide apparatus is less than the thickness of material introduced into the guide apparatus.

12. The device of claim 9, wherein the belt is a loop in which a plurality of polyhedral blocks are sequentially connected.

13. The device of claim 12, wherein the mold comprises a curved and inclined inlet in order to increase the amount of contact between the guide apparatus and the material.

14. The device of claim 12, wherein a frictional contact with materials in the guide apparatus comprises a groove corresponding to the cross-sectional shape of the material.

15. The device of claim 1, wherein the device additionally comprises a rotary guide for exiting shear-deformed materials.

16. The device of claim 15, wherein a frictional contact with materials in the guide apparatus comprises a groove corresponding to the cross-sectional shape of the materials.

17. The device of claim 15, wherein a belt transmission is used as the guide, and the belt transmission transfers the material immediately after shear deformation to the outside of the outlet of the mold by frictional contact between the belt and the shear-deformed materials.

* * * * *